US005170681A

United States Patent [19]

Kemp

[11] Patent Number: 5,170,681

[45] Date of Patent: Dec. 15, 1992

[54] WRENCH APPARATUS

[76] Inventor: Gloria Kemp, P.O. Box 297, Ada, Okla. 74820

[21] Appl. No.: 855,216

[22] Filed: Mar. 20, 1992

[51] Int. Cl.[5] ..... B25B 13/02

[52] U.S. Cl. ..... 81/176.15; 7/138

[58] Field of Search ..... 81/124.2, 119, 176.1, 81/176.15, 176.2, 176.3; 7/138

[56] References Cited

U.S. PATENT DOCUMENTS

| | | | |
|---|---|---|---|
| D. 277,729 | 2/1985 | Maxwell | D8/14 |
| D. 284,637 | 7/1986 | Erickson et al. | D8/41 |
| D. 311,315 | 10/1990 | Duke | D8/25 |
| 342,824 | 6/1986 | Clark . | |
| 423,288 | 3/1890 | Tefft et al. | 81/176.15 X |
| 1,416,461 | 5/1922 | Hance . | |
| 1,467,936 | 9/1923 | Janssen | 81/176.15 X |
| 3,213,720 | 10/1965 | Wallis et al. | 81/176.1 |
| 4,059,033 | 11/1977 | Johnson | 81/3.1 B |
| 4,209,903 | 7/1980 | Owens | 30/302 |
| 4,358,142 | 11/1982 | Montalvo | 294/19 R |
| 4,836,065 | 6/1989 | Setliff | 81/124.2 |

*Primary Examiner*—D. S. Meislin

*Attorney, Agent, or Firm*—Glen M. Burdick; Bill D. McCarthy

[57] ABSTRACT

A wrench apparatus is provided for selectively rotating and removing a control plate located in a skimmer of a swimming pool filter system. The wrench apparatus comprises an ear member engaging assembly for engaging upwardly extending ear members defined on the control plate. The ear member engaging assembly is connected to a wrench support housing member which is, in turn, connected to an extension member. An upper portion of the extension member is connected to a handle member. The wrench apparatus may further comprise a control plate lift assembly for facilitating the removal of the control plate after the control plate has been rotated to a removal position.

15 Claims, 2 Drawing Sheets

WRENCH APPARATUS

BACKGROUND OF THE INVENTION

1. Field of the Invention

The present invention relates to a wrench for imparting a torque on an object, and more particularly, but not by way of limitation, to a wrench apparatus for selectively rotating and removing a control plate located in a skimmer of a swimming pool filter system.

2. Description of Prior Art

Swimming pools are typically constructed with a filter system to remove dirt and debris from the pool water. The filter system is provided with a pump which withdraws water from the pool through an inlet port, passes the water through a filter, and injects the filtered water back into the pool via outlet ports positioned on the sides of the pool. The inlet port of the filter system is commonly located in the bottom of a skimmer, a reservoir placed adjacent to the pool to collect larger debris floating on the surface of the water, such as bugs and leaves.

Several designs for skimmers exist in the swimming pool industry. That is, the design of a skimmer may vary in the accessories and the positioning of such accessories in the skimmer, as well as in the design of the plumbing for the skimmer However, a common skimmer design for swimming pools has an inlet port for the filter system located on the bottom of the skimmer and a port positioned on the side of the skimmer which is connected to the main drain so that water is circulated from the drain to the filter system via the skimmer. A filter basket is inserted in the bottom portion of the skimmer to collect the larger debris floating on the surface of the water. In addition, a control plate is secured in the skimmer above the filter basket to control the rate of water flowing through the upper portion of the skimmer and to provide a convenient way to connect a vacuum device to the filter system in order to clean the bottom of the pool.

The control plate is a substantially funnel-shaped member having a central opening. The rate water flows through the central opening of the control plate is dependent on the rotational positioning of the control plate. By engaging upwardly extending ear members on the control plate, the control plate can be selectively rotated between a normal operating position, a vacuuming position and a removal position.

In the normal operating position, the filter basket collects debris from the water flowing through the central opening of the control plate, as well as debris in the water flowing into the skimmer from the main drain. In the vacuuming position, the control plate is rotated so that the port from the main drain is blocked. Thus, the flow rate of water through the central opening of the control plate is increased which enhances the suction available to a vacuum device connected to the control plate. On the other hand, when the control plate is rotated to the removal position, the control plate can be removed from the skimmer so that the filter basket can be emptied.

The control plate is rotatably secured in the skimmer by inserting male members of the control plate into a female member of the skimmer, typically a groove formed in the side of the skimmer. This groove often becomes filled with dirt and debris which, in combination with a rubber seal located about the peripheral edge of the control plate, makes rotation of the control plate difficult. Consequently, conventional wrenches are often used to rotate the control plate. However, use of tools such as conventional wrenches may result in the breaking-off of the ear members from the control plate. In addition to problems in rotating the control plate, difficulties also arise in removing the control plate from the skimmer as a result of the awkward placement of the control plate in the skimmer.

Thus, a need has long existed for a wrench apparatus which enables a control plate located in a skimmer to be easily rotated to a desired operational position and, at the same time, provides a convenient way to remove the control plate from the skimmer. It is to such a wrench apparatus that the present invention is directed.

SUMMARY OF THE INVENTION

The present invention relates to a wrench apparatus for selectively rotating and removing a control plate located in a skimmer of a swimming pool filter system. The wrench apparatus, which is adapted to engage upwardly extending ear members of the control plate so that torque can be applied to the control plate to selectively rotate the control plate between an operating position, a vacuuming position and a removal position, comprises a handle member, an extension member, a wrench support housing member and an ear engaging assembly. The handle member is connected to one end of the extension member and the wrench support housing is connected to an opposed end portion thereof. The ear member engaging assembly, which is adapted to engage the upwardly extending ear members of the control plate, is connected to the wrench support housing member so as to extend outwardly therefrom.

The wrench apparatus of the present invention further comprises a control plate lift assembly for facilitating removal of the control plate from the skimmer when the control plate has been selectively rotated to its removal position. The control plate lift assembly comprises a control rod and a pair of control plate lift members pivotally connected to a lower end portion of the control rod. The control plate lift members are selectively movable between an extended position and a retracted position in response to movement of the control rod. In the extended position the control plate lift members extend outwardly in opposite directions so as to engage a bottom portion of the control plate and enhance removal of the control plate from the skimmer.

An object of the present invention is to provide a wrench apparatus for selectively rotating a control plate located in a skimmer of a swimming pool filter system.

Another object of the present invention, while achieving the before-stated object, is to provide a wrench apparatus to facilitate the removal of a control plate located in a skimmer of a swimming pool filter system.

Another object of the present invention, while achieving the before-stated objects, is to provide a wrench apparatus which is economical to manufacture, durable in construction, and which permits one to more easily maintain and service a swimming pool.

Other objects, features and advantages of the present invention will become apparent from the following detailed description when read in conjunction with the drawings and appended claims.

DETAILED DESCRIPTION

Figure 1:
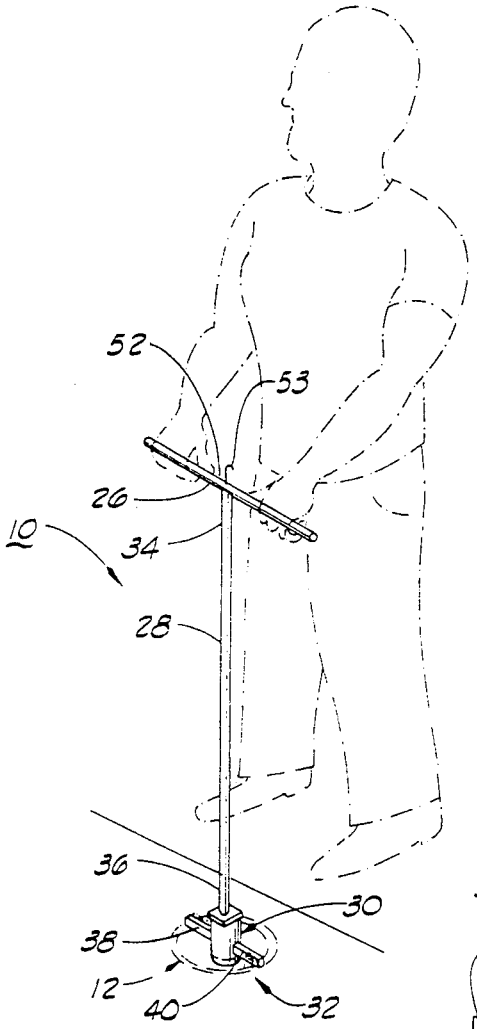
FIG. 1 is a perspective view of a wrench apparatus constructed in accordance with the present invention.
Figure 2:
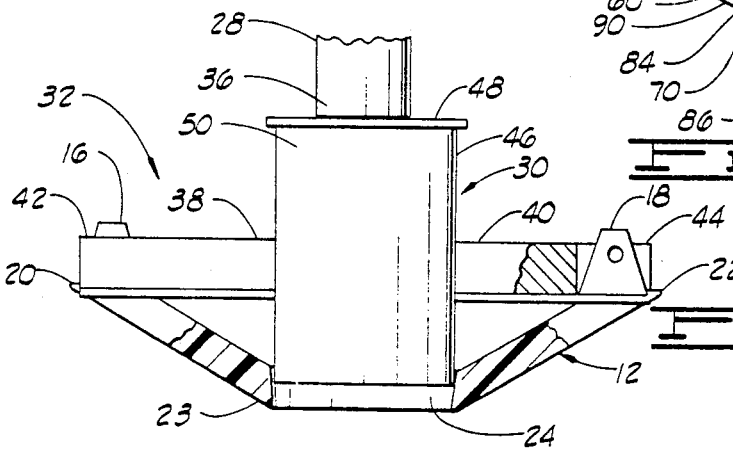
FIG. 2 is an elevational view, partially in cross section, of a portion of the wrench apparatus of FIG. 1 illustrating the ear member engaging assembly.

Referring now to the drawings, and more specifically to FIGS. 1 and 2, a wrench apparatus 10 constructed in accordance with the present invention is illustrated. The unique design of the wrench apparatus 10 enables one to selectively rotate a control plate 12 located in a skimmer (not shown) of a swimming pool filter system (also not shown) between an operating position, a vacuuming position, and a removal position.

The control plate 12, shown partially cut away in FIG. 2, is a substantially funnel-shaped member having ear members 16, 18, male retaining members 20, 22, a bottom portion 23 and a central opening 24. The male retaining members 20, 22 of the control plate 12 are slidably received by a female member (not shown), such as a groove, formed in the side wall of the skimmer so that the control plate 12 can be secured in a stable position. The ear members 16, 18 of the control plate 12 extend upwardly therefrom and enable one to selectively rotate the control plate 12 to the desired operational position, or to the removal position.

Skimmers and control plates are well known in the art. Thus, no further description of the skimmer and the control plate 12 is believed necessary in order to enable one skilled in the art to understand the construction and operation of the wrench apparatus 10 of the present invention.

The wrench apparatus 10 comprises a handle member 26, an extension member 28, a wrench support housing member 30 and an ear member engaging assembly 32. The handle member 26 is connected to an upper end portion 34 of the extension member 28; and the wrench support housing member 30 is connected to a lower end portion 36 of the extension member 28. The ear member engaging assembly 32, which is adapted to engage the ear members 16, 18 of the control plate 12, is connected to the wrench support housing member 30 so as to extend outwardly therefrom substantially as shown.

The ear member engaging assembly 32 comprises first and second ear member engaging yokes 38, 40. The first and second ear member engaging yokes 38, 40 are connected to the wrench support housing member 30 by any suitable means, such as welding, so that the first and second ear member engaging yokes 38, 40 extend outward therefrom in opposite directions. The first and second ear member engaging yokes 38, 40 are provided with substantially U-shaped distal end portions 42, 44 adapted to receive the ear members 16, 18 of the control plate 12 so that the control plate 12 can be selectively rotated in either a clockwise or counter clockwise direction in response to rotational movement imparted to the control plate 12 by the wrench apparatus 10.

The wrench support housing member 30 comprises a yoke support member 46 having a support plate 48 connected to one end 50 thereof. The yoke support member 46 is a cylindrical member dimensioned to either pass into the central opening 24 of the control plate 12 or to abut the control plate 12 in order to provide vertical support to the wrench apparatus 10 when the substantially U-shaped distal end portions 42, 44 of the ear member engaging assembly 32 engage the ear members 16, 18 of the control plate 12. Thus, when employing the wrench apparatus 10, the breaking-off of the ear members 16, 18 from the control plate 12 is substantially eliminated because of the application of substantially uniform torque to the ear members 16, 18 of the control plate 12 when the control plate 12 is selectively rotated between the operational position, the vacuuming position or the removal position by the wrench apparatus 10.

The lower end portion 36 of the extension member 28 is connected to the support plate 48 of the wrench support housing member 30; and the upper end portion 34 of the extension member 28 is connected to a medial portion 52 of the handle member 26 so that the handle member 26 is disposed substantially perpendicular to the extension member 28.

To permit the user of the wrench apparatus 10 illustrated in FIGS. 1 and 2 to lift the control plate 12 so as to provide access to the filter basket (not shown) of the skimmer, the wrench apparatus 10 further comprises a hook member 53. The hook member 53, which is supported by the handle member 26 substantially as shown, is adapted to selectively engage the control plate 12 and the filter basket of the skimmer so that such components can readily be removed or replaced by applying a lifting force to the wrench apparatus 10. Thus, the wrench apparatus 10 not only provides a convenient implement to selectively rotate the control plate 12 between its various operating positions and its removal position (without requiring one to bend over or stoop), the wrench apparatus 10 also provides a convenient way to lift the control plate 12 and the filter basket from the skimmer well without bending over or stooping.

Figure 3:
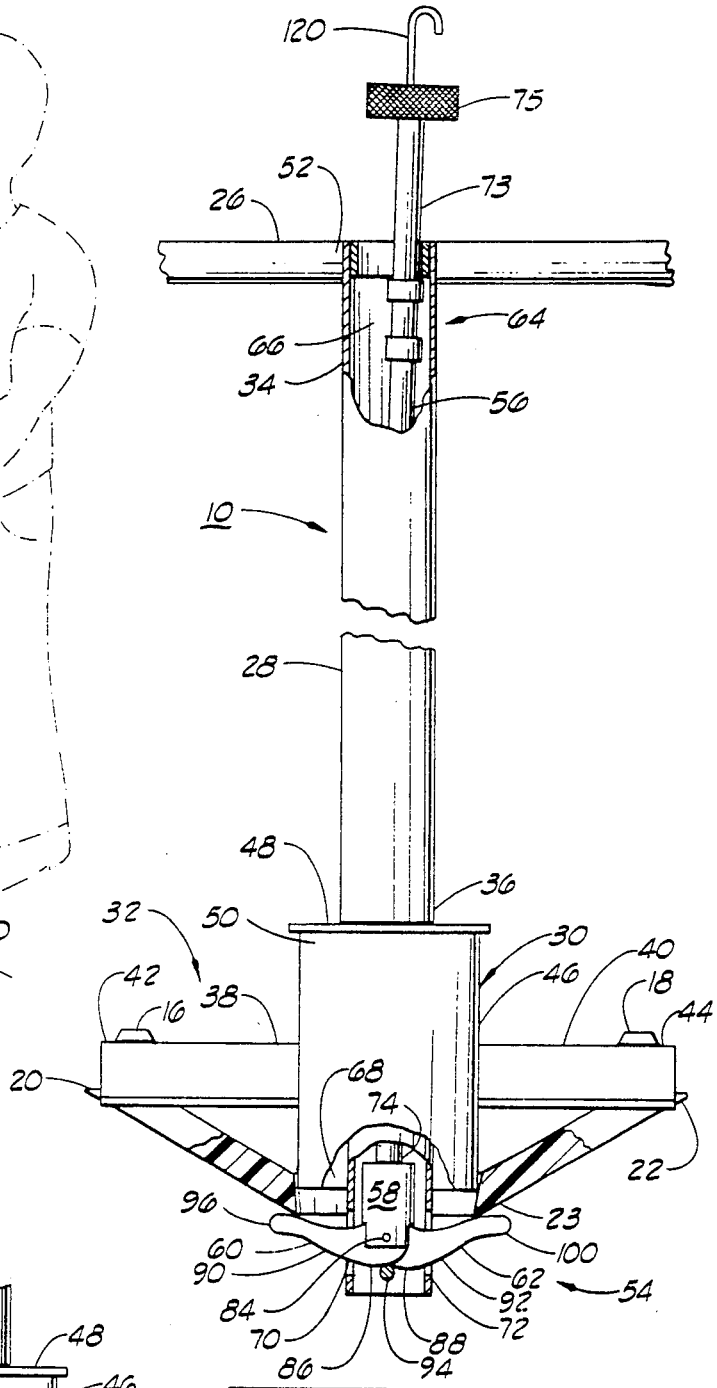
FIG. 3 is a partially cut away, elevational view of the wrench apparatus of the present invention having a control plate lift assembly incorporated therein

Referring now to FIG. 3, the wrench apparatus 10 is illustrated having a control plate lift assembly 54 for removing the control plate 12 (shown partially cut away) from the skimmer (not shown) when the control plate 12 has been rotated to the removal position. The control plate lift assembly 54, which is selectively movable between the extended position (FIGS. 3 and 5) and the retracted position (FIG. 4), comprises a control rod 56, a yoke member 58, a pair of control plate lift members 60, 62, and a control rod securing assembly 64.

The extension member 28 of the wrench apparatus 10 is provided with a central bore 66 extending longitudinally therethrough so that the extension member 28 constitutes a housing for the control plate lift assembly 54. The handle member 26 is connected to the upper end portion 34 of the extension member 28 substantially as shown in FIG. 3. The extension member 28 is connected to the wrench support housing member 30 such that the lower end portion 36 of the extension member 28 extends through a vertically oriented passageway 68 in the wrench support housing member 30. The lower end portion 36 of the extension member 28 is provided with oppositely disposed slots 70, 72; and the lower end portion 36 of the extension member 28 is dimensioned to pass through the central opening 24 of the control plate 12 when the control plate lift members 60, 62 are in the retracted position. The slots 70, 72 are aligned and vertically oriented so as to provide a passageway for the control plate lift members 60, 62 as same move between the retracted position and the extended position.

Referring now to FIGS. 3–7, the control rod 56 is characterized as having an upper end portion 73 and a threaded lower end portion 74. The control rod 56 is disposed in the central bore 66 of the extension member 28 so that the upper end portion 73 thereof extends outwards from the upper end portion 34 of the extension member 28. A knob 75 is connected to the upper end portion 73 of the control rod 56 so that the control rod 56 can be moved in a lateral and a vertical direction. Movement of the control rod 56, which will be discussed in more detail hereinafter, selectively moves the control plate lift members 60, 62 between the retracted position and the extended position.

The yoke member 58 is provided with a substantially cylindrically shaped upper end portion 76 and a substantially yoke-shaped lower end portion 78. Further, the yoke member 58 is dimensioned to slidably move within the central bore 66 of the extension member 28. That is, the yoke member 58 can be selectively moved in an up and down direction through the central bore 66 of the extension member 28 in response to vertical movement of the control rod 56.

Figure 7:
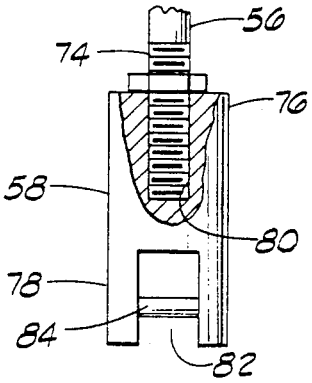
FIG. 7 is a partially cut away, side elevational view of a portion of the wrench apparatus of FIG. 3 illustrating the attachment of the control rod to a yoke member.

The upper end portion 76 of the yoke member 58 is provided with a threaded bore 80 adapted to receive the threaded lower end portion 74 of the control rod 56; and the lower end portion 78 of the yoke member 58 is provided with a slot 82 extending therethrough (FIG. 7). A pivot pin 84 pivotally connects first end portions 86, 88 of the control plate lift members 60, 62 to the lower end portion 78 of the yoke member 58 so that the control plate lift members 60, 62 can be selectively moved between the retracted position (FIG. 4) and the extended position (FIGS. 3 and 5) in response to vertical movement of the control rod 56.

Figure 4:
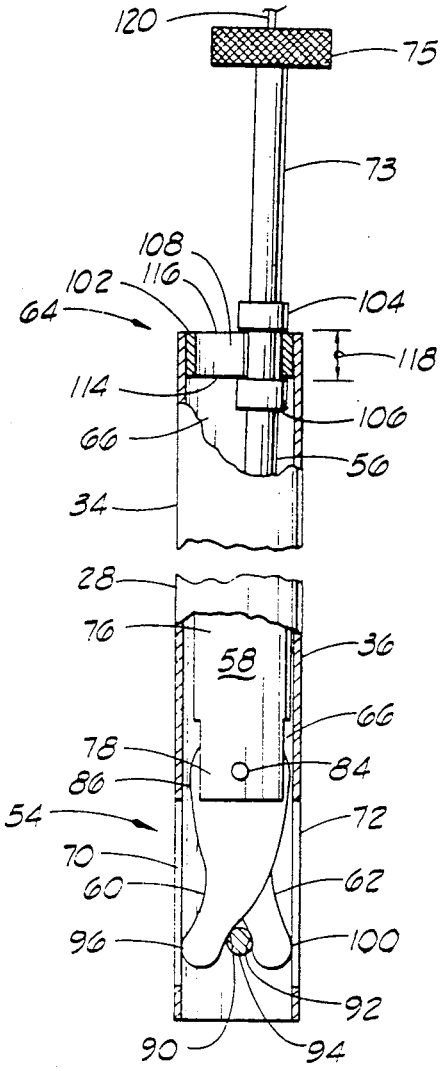
FIG. 4 is a partially cut away, elevational view of a portion of the wrench apparatus in FIG. 3 illustrating the control plate lift assembly in a retracted position.

The control plate lift members 60, 62 are arcuate-shaped members having cam surfaces 90, 92, respectively. A cam pin 94 is disposed in the lower end portion 36 of the extension member 28 so as to transverse the central bore 66 of the extension member 28. The cam pin 94 cooperates with the cam surfaces 90, 92 of the control plate lift members 60, 62 to selectively move the control plate lift members 60, 62 to the extended position or the retracted position in response to vertical movement of the control rod 56. That is, when the control plate lift members 60, 62 are moved to the extended position by a downward movement of the control rod 56, the cam surfaces 90, 92 of the control plate lift members 60, 62 slidably contact the cam pin 94; whereas, when the control plate lift members 60, 62 are moved to the retracted position in response to an upward movement of the control rod 56, the cam surfaces 90, 92 of the control plate lift members 60, 62 are pulled away from the cam pin 94. Thus, when the control plate lift members 60, 62 are in the retracted position, a second end 96 of the control plate lift member 60 and a second end 100 of the control lift plate member 62 remains in engaging contact with the cam pin 94 substantially as shown in FIG. 4. However, when the control plate lift members 60, 62 are in the extended position, the first end portions 86, 88 of the control plate lift members 60, 62 abuttingly engage the cam pin 94 and the second ends 96, 100 of the control plate lift members 60, 62 extend outwardly through the slots 70, 72 in the lower end portion 36 of the extension member 28 and engage the bottom portion 23 of the control plate 12 so that the control plate 12 (FIG. 3) can be removed from a skimmer (not shown) by applying a lifting force to the wrench apparatus 10. Further details of the operation of the control plate lift assembly 54 will be described hereinafter.

Figure 5:
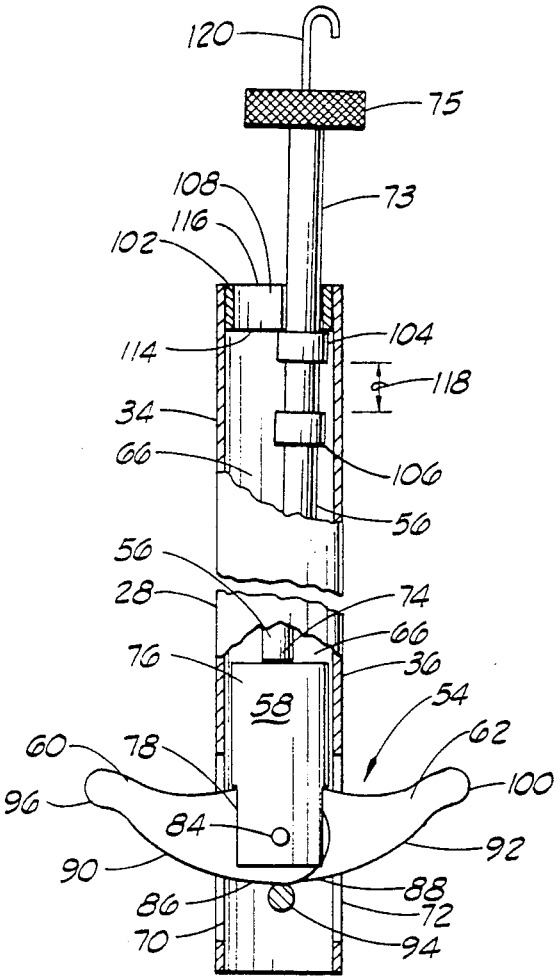
FIG. 5 is a partially cut away, elevational view of a portion of the wrench apparatus in FIG. 3 illustrating the control plate lift assembly in an extended position.
Figure 6:
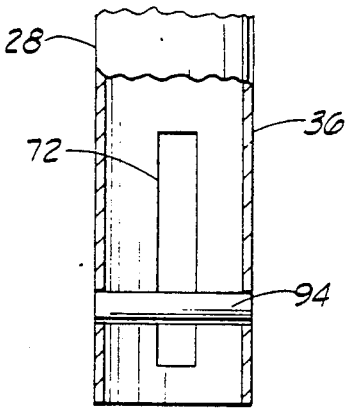
FIG. 6 is a side elevational view, partially in cross section, of a lower portion of the extension member of FIG. 3.

Referring now to FIGS. 4 and 5, the control rod securing assembly 64 for securing the control plate lift members 60, 62 in either the extended or the retracted position will now be described. The control rod securing assembly 64 comprises a guide plug 102, a first stop member 104 and a spatially disposed second stop member 106. The guide plug 102 is connected to the upper end portion 34 of the extension member 28 by any suitable means, such as a screw (not shown).

Figure 8:
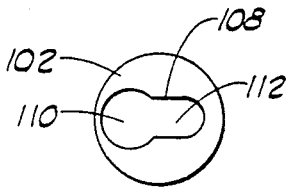
FIG. 8 is a top plan view of a guide plug utilized in the wrench apparatus of FIG. 3.

As more clearly shown in FIG. 8, the guide plug 102 is provided with a substantially key-shaped opening 108 having an enlarged first end portion 110 and a second end portion 112. The substantially key-shaped opening 108, which openly communicates with the central bore 66 extending through the extension member 28, is dimensioned to slidably receive the control rod 56 so that the control rod 56 can be vertically displaced to selectively move the control plate lift members 60, 62 between their extended position and their retracted position.

Referring again to FIGS. 4 and 5, the first stop member 104 is connected to the upper end portion 73 of the control rod 56 so as to be disposed substantially adjacent a lower side 114 of the guide plug 102 when the control plate lift members 60, 62 are in the extended position substantially as shown in FIG. 5; whereas, when the control plate lift members 60, 62 are in the retracted position, the first stop member 104 is supported by an upper side 116 of the guide plug 102 when the control rod 56 is disposed in the second end portion 112 of the substantially key-shaped opening 108. Thus, the diameter of the first stop member 104 must be larger than the diameter of the second end portion 112 of the substantially key-shaped opening 108, but less than the diameter of the enlarged first end portion 110 in order to permit the first stop member 104 to be selectively moved through the enlarged first end portion 110 of the key-shaped opening 108, while at the same time being retained in a stable position by the guide plug 102 when the control rod 56 is laterally moved so as to be disposed in the second end portion 112 of the key-shaped opening 108.

The second stop member 106 is connected to the upper end portion 73 of the control rod 56 a distance 118 from the first stop member 104. The distance 118 is greater than the thickness of the guide plug 102 so that the control rod 56 can be be selectively moved between the enlarged first end portion 110 and the second end portion 112 of the key-shaped opening 108 in order to secure the control rod 56 in a desired position so that the control lift plate members 60, 62 are maintained in one of the retracted and extended positions. Further, the diameter of the second stop member 106 is greater than the diameter of the enlarged first end portion 110 of the key-shaped opening 108 so that the second stop member 106 is prevented from passing through the key-shaped opening 108. Thus, the second stop member 106, in cooperation with the first stop member 104, secures the control plate lift members 60, 62 in the retracted position when the control rod 56 is disposed in the second end portion 112 of the key-shaped opening 108 and the first stop member 104 is supported by the upper side 116 of the guide plug 102. Further, the second stop member 106 prevents further upward extension of the control rod 56 so that the control plate lift members 60, 62 maintain contact with the cam pin 94 when the control plate lift members 60, 62 are in the retracted position.

That is, the first and second stop members 104, 106 of the control rod securing assembly 64, in combination with the cam pin 94 and the key-shaped opening 108, limit the vertical movement of the control rod 56 during the positioning of the control plate lift members 60, 62 in either the extended position or the retracted position.

To permit the user of the wrench apparatus 10 illustrated in FIGS. 3–5 to lift the filter basket (not shown) from the skimmer after removal of the control plate 12, the wrench apparatus 10 further comprises a hook member 120. The hook member 120, which is supported by the knob 75 substantially as shown, is adapted to selectively engage the filter basket of the skimmer so that the filter basket can readily be removed or replaced by applying a lifting force to the wrench apparatus 10. Thus, the wrench apparatus 10 not only provides a convenient implement to selectively rotate the control plate 12 between its various operating positions, the wrench apparatus 10 also provides a convenient means to remove the control plate 12 from the skimmer well without requiring one to bend over or stoop, as well as a means to remove the filter basket from the skimmer well without bending over or stooping.

The wrench apparatus 10 of the present invention can be constructed of any suitable material having sufficient strength to provide the desired torque to the ear members 16, 18 of the control plate 12 so that the control plate 12 can be selectively moved between its operational position, vacuuming position, and removal position. Further, the control plate lift members 60, 62 of the control plate lift assembly 54 can be fabricated of any suitable material provided that such members have sufficient strength to engage and lift the control plate 12 when the control plate 12 has been selectively rotated to its removal position and the wrench apparatus 10 connected thereto so that that the control plate lift members 60, 62 engage the bottom portion 23 of the control plate 12 when same are in their extended position.

In order to further assist one in understanding the wrench apparatus 10 of the present invention, a mode of operation for the wrench apparatus 10 will now be set forth

OPERATION

When employing the wrench apparatus 10 shown in FIGS. 1 and 2 to rotate the control plate 12 to its operating position, vacuuming position, or removal position, the wrench apparatus 10 is positioned on the control plate 12 so that the ear members 16, 18 of the control plate 12 are disposed within the substantially U-shaped distal end portions 42, 44 of the first and second ear member engaging yokes 38, 40. Torque is then applied to the handle member 26 so that the control plate 12 can be rotated to the desired position. After the control plate 12 has been rotated, the wrench apparatus 10 is removed from engaging contact with the ear members 16 and 18 of the control plate 12.

If the control plate 12 is to be removed the control plate 12 is rotated to the removal position and the wrench apparatus 10 is inverted so that the hook member 53 hookingly engage the control plate 12. Thereafter, the control plate 12 can be removed by applying a lifting force to the wrench apparatus 10. The filter basket can then also be removed if desired using the wrench apparatus 10.

When employing the wrench apparatus 10 having the control plate lift assembly 54 illustrated in FIG. 3, the wrench apparatus 10 is positioned on the control plate 12 so that the lower end portion 36 of the extension member 28 is disposed through the central opening 24 of the control plate 12 and the ear members 16, 18 of the control plate 12 are disposed within the substantially U-shaped distal end portions 42, 44 of the first and second ear member engaging yokes 38, 40. Torque is then applied to the handle member 26 so that the control plate 12 can be rotated to the desired position. It should be noted that during connection of the wrench apparatus 10 to the control plate 12, as well as during the rotation of the control plate 12 with the wrench apparatus 10, the control plate lift members 60, 62 of the control plate lift assembly 54 are desirably retained in the retracted position substantially as shown in FIG. 4.

When the control plate 12 has been rotated to its removal position, and it is desired to remove the control plate 12 from the skimmer (not shown), the control plate lift members 60, 62 of the control plate lift assembly 54 are moved to their extended position (FIGS. 3 and 5) by the control rod 56. In the extended position the second ends 96, 100 of the control plate lift members 60, 62 engage the bottom portion 23 of the control plate 12 so that the control plate 12 (when in its removal position) can be removed from the skimmer by applying a lifting force to the wrench apparatus 10.

As previously stated, the control plate lift members 60, 62 are selectively moved to the extended position by activation of the control plate lift assembly 54. Activation of the control plate lift assembly 54 is achieved by sliding the control rod 56 from the second end portion 112 of the substantially key-shaped opening 108 in the guide plug 102 to the enlarged first end portion 110 of the substantially key-shaped opening 108. Thus, one can then move the control rod 56 in a downward direction so that the first stop member 104 passes through the enlarged first end portion 110 of the substantially key-shaped opening 108 of the guide plug 102. Downward movement of the control rod 56 causes the cam surfaces 90, 92 of the control plate lift members 60, 62 to slide on the cam pin 94, which results in the control plate lift members 60, 62 extending outwardly through the slots 70, 72 in the lower end portion 36 of the extension member 28. Once the control plate lift members 60, 62 have reached their extended position, the control plate lift members 60, 62 are secured in the extended position by sliding the control rod 56 into the second end portion 112 of the substantially key-shaped opening 108 of the guide plug 102 so that the first stop member 104 abuttingly engages the lower side 114 of the guide plug 102. Thus, the control plate lift members 60, 62 are secured in an extended position and abuttingly engage the bottom portion 23 of the control plate 12 so that the control plate 12 can be removed from the skimmer by merely lifting the wrench apparatus 10.

When it is desired to remove the wrench apparatus 10 from the control plate 12, the control lift plate members 60, 62 are moved to their retracted position within the lower end portion 36 of the extension member 28. Retraction of the control lift plate members 60, 62 (which results in disengagement of the control plate 12) is achieved by sliding the control rod 56 from the second end portion 112 of the substantially key-shaped opening 108 in the guide plug 102 to the enlarged first end portion 110 thereof. Thereafter, an upward force is applied to the control rod 56 so that first stop member 104 passes through the enlarged first end portion 110 of the substantially key-shaped opening 108 of the guide plug 102. The upward movement of the control rod 56 causes the control lift plate members 60, 62 to be retracted into the lower end portion 36 of the extension member 28 via the oppositely disposed slots 70, 72 formed in the lower end portion 36 of the extension member 28. The control rod 56 is then slidably moved so as to be disposed in the second end portion 112 of the substantially key-shaped opening 108 where the first stop member 104 abuttingly engages the upper side 116 of the guide plug 102 adjacent the second end portion 112 of the key-shaped opening 108. Thus, the control rod securing assembly 64 secures the control plate lift members 60, 62 in the retracted position which enables one to remove the wrench apparatus 10 from the control plate 12.

Once the control plate 12 has been removed, the wrench apparatus 10 can be employed to remove the filter basket. To remove the filter basket the wrench apparatus 10 is inverted so that the hook member 120 can be brought into hooking engagement with the filter basket. Thereafter, the filter basket can be removed from the skimmer well by merely applying an upwardly directed force on the wrench apparatus 10.

It is clear that the present invention is well adapted to carry out the objects and to obtain the ends and advantages mentioned as well as those inherent therein. While a presently preferred embodiment of the invention has been described for purposes of this disclosure, it will be recognized that numerous changes may be made which will readily suggest themselves to those skilled in the art and which are encompassed within the spirit of the invention disclosed and as defined in the appended claims.

What is claimed is:

1. A wrench apparatus for selectively rotating and removing a control plate located in a skimmer of a swimming pool filter system, the control plate having upwardly extending ear members and a central opening, the control plate selectively rotatable between a normal operating position, a vacuuming position, and a removal position, the apparatus comprising:

a handle member;

an extension member having an upper end portion, a lower end portion, and a central bore extending longitudinally therethrough, the upper end portion connected to the handle member such that the central bore is substantially unrestricted by the handle member;

a wrench support housing member connected to the lower end portion of the extension member for providing vertical support relative to the control plate, the lower end portion of the extension member extending through a vertical oriented passageway formed by the wrench support housing;

ear member engaging means connected to and extending outwardly from the wrench support housing member for engaging the ear members of the control plate so that torque may be imparted on the control plate to selectively rotate the control plate to on of the operating position, the vacuuming position or the removal position; and control plate lift means supported by the extension member for selectively engaging a bottom portion of the control plate so that the control plate can be removed from the skimmer when the control plate is rotated to the removal position.

2. The wrench apparatus of claim 1 wherein the ear member engaging means comprises:

a first and a second ear member engaging yoke, the first and second ear member engaging yokes connected to the wrench support housing member such that the first and second ear member engaging yokes extend outwardly from the wrench support housing member in oppositely disposed directions, each ear member engaging yoke having a substantially U-shaped distal end portion for engaging the ear members of the control plate.

3. The wrench apparatus of claim 2 wherein the lower end portion of the extension member extending through the wrench support housing member is provided with a cam pin and oppositely disposed, vertically oriented slots, and wherein the control plate lift means comprises:

a control rod having an upper end portion and lower end portion, the control rod dispensed in the central bore of the extension member such that the upper end portion extends outwardly therefrom;

a yoke member connected to the lower end portion of the control rod;

a pair of control plate lift members, each of the control plate lift members having a cam surface and pivotally connected to the yoke member, the control plate lift members selectively movable between an extended position and a retracted position, in the extended position the control plate lift members extending outwardly and in opposite directions through the slots in the lower end portion of the extension member; and control rod securing means for securing the control rod in a desired position so as to retain the control plate lift members in one of the extended position and the retracted position.

4. The wrench apparatus of claim 3 wherein the control rod securing means comprises:

a guide plug secured within an upper end portion of the extension member, the guide plug having a substantially key-shaped opening extending therethrough, the substantially key-shaped opening communicating with the central bore of the extension member, the substantially key-shaped opening having an enlarged first end portion and a second end portion, each of which is dimensioned to slidably receive the control rod;

a first stop member connected to the upper end portion of the control rod and having a diameter less than the diameter of the enlarged first end portion of the key-shaped opening but greater than the diameter of the second end portion of the key-shaped opening so that when the control rod is disposed in the second end portion of the key-shaped opening the first stop member abuttingly engages a lower side of the guide plug and secures the control plate lift members in the extended position; and a second stop member connected to the upper end portion of the control rod a predetermined distance below the first support member, the second stop member having a diameter greater than the diameter of the enlarged first end portion of the key-shaped opening so that when the first stop member is withdrawn through the enlarged first end portion of the key-shaped opening further upward movement of the control rod is prevented by the second stop member abuttingly engaging the lower side of the guide plug.

5. The wrench apparatus of claim 4 wherein the extension member is dimensioned so as to be slidably disposed in the central opening of the control plate when the control plate lift members are in the retracted position.

6. The wrench apparatus of claim 3 wherein the control rod is provided with a knob attached at the upper end portion of the control rod so that the control rod can be moved in a lateral and a vertical direction.

7. The wrench apparatus of claim 6 wherein the skimmer is provided with a filter basket and wherein the wrench apparatus further comprises:

hook means supported by the knob for selectively engaging the filter basket after removal of the control plate and permitting removal of the filter basket from the skimmer.

8. A wrench apparatus for selectively rotating and removing a control plate located in a skimmer of a swimming pool filter system, the control plate selectively rotatable between an operating position, a vacuuming position, and a removal position, the control plate having upwardly extending ear members and a central opening, the wrench apparatus comprising:

a handle member;

an extension member having an upper end portion and a lower end portion, the handle member connected to the upper end portion thereof;

a wrench support housing member connected to the lower end portion of the extension member;

ear member engaging means connected to and extending from the wrench support housing member for engaging the ear members of the control plate so that torque may be imparted on the control plate to rotate same to the desired position;

wherein the ear member engaging means comprises:

a first ear member engaging yoke connected to the wrench support housing member; and a second ear member engaging yoke connected to the wrench support housing such that the first and second ear member engaging yokes extend from the wrench support housing member in opposite directions, each of the first and second ear member engaging yokes having a substantially U-shaped distal end portion for engaging the ear members of the control plate; and wherein the control plate is characterized as having a bottom portion and wherein the wrench apparatus further comprises:

control plate lift means directly supported by the extension member for engaging the bottom portion of the control plate so that the control plate can be removed by application of an upwardly directed force on the handle member.

9. The wrench apparatus of claim 8 wherein the extension member is provided with a central bore extending longitudinally therethrough and the lower end portion of the extension member is provided with a cam pin and oppositely disposed, vertically oriented slots, and wherein the control plate lift means comprises:

a control rod disposed in the central bore of the extension member having an upper end portion and a lower end portion;

a yoke member connected to the lower end portion of the control rod; and a pair of control plate lift members, each of the control plate lift members having a cam surface and pivotally connected to the yoke member, the control plate lift members selectively movable between an extended position and a retracted position, in the extended position the control plate lift members extending in opposite directions through the slots found in the lower end portion of the extension member, in the retracted position the control plate lift members disposed in the central bore of the extension member.

10. The wrench apparatus of claim 9 wherein the extension member is dimensioned so as to be slidably disposed in the central opening of the control plate when the control plate lift members are in the retracted position.

11. The wrench apparatus of claim 10 further comprising control rod securing means for securing the control rod in a desired position so as to retain the control plate lift members in one of the extended position and the retracted position.

12. The wrench apparatus of claim 11 wherein the control rod securing means comprises:

a guide plug secured within an upper end portion of the extension member, the guide plug having a substantially key-shaped opening extending therethrough, the substantially key-shaped opening communicating with the central bore of the extension member, the substantially key-shaped opening having an enlarged first end portion and a second end portion, each of which is dimensioned to slidably receive the control rod;

a first stop member connected to the upper end portion of the control rod and having a diameter less than the diameter of the enlarged first end portion of the key-shaped opening but greater than the diameter of the second end portion of the key-shaped opening so that when the control rod is disposed in the second end portion of the key-shaped opening the first stop member abuttingly engages a lower side of the guide plug and secures the control plate lift members in the extended position; and a second stop member connected to the upper end portion of the control rod a predetermined distance below the first support member, the second stop member having a diameter greater than the diameter of the enlarged first end portion of the key-shaped opening so that when the first stop member is withdrawn through the enlarged first end portion of the key-shaped opening further upward movement of the control rod is prevented by the second stop member abuttingly engaging the lower side of the guide plug.

13. The wrench apparatus of claim 12 further comprising: a knob attached at the upper end portion of the control rod.

14. The wrench apparatus of claim 13 wherein the skimmer is provided with a filter basket and wherein the wrench apparatus further comprises:

hook means supported by the knob for selectively engaging the filter basket after removal of the control plate and permitting removal of the filter basket from the skimmer.

15. The wrench apparatus of claim 8 further comprising:

a hook member connected to the handle member so as to extend upwardly therefrom.

* * * * *